US006112339A

United States Patent [19]

Nichols et al.

[11] Patent Number: 6,112,339

[45] Date of Patent: Sep. 5, 2000

[54] PORTABLE TODDLER/YOUNG CHILD POTTY

[76] Inventors: Michelle Nichols; Robert Coury Nichols, both of 990 N. Brys, Grosse Pointe Woods, Mich. 48236

[21] Appl. No.: 09/232,285

[22] Filed: Jan. 15, 1999

Related U.S. Application Data

[60] Provisional application No. 60/071,555, Jan. 15, 1998.

[51] Int. Cl.[7] ..... A47K 11/04

[52] U.S. Cl. ..... 4/484; 4/483; 4/239

[58] Field of Search ..... 4/239, 483, 484

[56] References Cited

U.S. PATENT DOCUMENTS

| | | | |
|---|---|---|---|
| D. 345,202 | 3/1994 | Crossley et al. | D23/296 |
| D. 345,414 | 3/1994 | Douglas | D23/296 |
| D. 374,069 | 9/1996 | Her | D23/299 |
| 496,536 | 5/1893 | Prins | 4/239 |
| 2,912,702 | 11/1959 | Mackenzie | 4/484 X |
| 4,525,880 | 7/1985 | Bass . | |
| 5,005,223 | 4/1991 | Greenwood | 4/235 |
| 5,008,964 | 4/1991 | Dean et al. | 4/449 X |
| 5,090,063 | 2/1992 | Edwards et al. | 4/239 |
| 5,161,263 | 11/1992 | Geneve et al. | 4/483 |
| 5,187,819 | 2/1993 | Grimes | 4/484 X |
| 5,377,364 | 1/1995 | Cabrera | 4/483 |
| 5,560,051 | 10/1996 | Butts | 4/479 |
| 5,575,021 | 11/1996 | Harris | 4/479 X |

*Primary Examiner*—Robert M. Fetsuga
*Attorney, Agent, or Firm*—Gifford, Krass, Groh, Sprinkle, Anderson & Citkowski, P.C.

[57] ABSTRACT

A child toilet assembly having a seat having a top surface and a bottom surface, a front region and a rear region, a central aperture disposed therein, and at least two downwardly extending legs. The legs being attached to a support and pivotable between an upward position for transporting the assembly and a downward position of use alone or with an existing conventional toilet seat. A container having an opening and an attachment mechanism is disposed adjacent to the opening, the attachment mechanism on the container being adapted to engage a retainer disposed adjacent to the central opening. A water-resistant liner is disposed within the container for receiving and retaining waste therein.

19 Claims, 4 Drawing Sheets

PORTABLE TODDLER/YOUNG CHILD POTTY

This application claims priority of U.S. Provisional Application Ser. No. 60/071,555 filed Jan. 15, 1998.

FIELD OF THE INVENTION

The subject invention relates to portable toilets and, more particularly, to a folding portable toilet which can be used with a conventional toilet or stand alone.

BACKGROUND OF THE INVENTION

Traveling with young children can present problems when the toddler/young child needs to use a potty. It is frequently difficult to find a bathroom or to find a bathroom that is sanitary or accommodating for use by an toddler or small child.

It is known to provide toddler/young child seats such as disclosed in U.S. Design Pat. No. 345,414 for placement over an existing adult toilet seat to provide a suitable child sized potty seat. However, such devices are unsatisfactory for use when a bathroom cannot be found or is unsanitary. Accordingly, it would be desirable to provide a child sized potty seat which is usable both with an existing adult toilet seat or on its own. Additionally, it is desirable that such a device be simply and easily used and readily transportable.

SUMMARY OF THE INVENTION

A child toilet assembly is disclosed having a seat having a top surface and a bottom surface, a front region and a rear region, and a central aperture disposed therein. At least two downwardly extending legs are attached to a support and are pivotable between an upward position for transporting the assembly and a downward position of use alone or with an existing conventional toilet seat. A container having an opening and an attachment mechanism is disposed adjacent to the opening. The attachment mechanism on the container is adapted to engage the retainer disposed adjacent to the central opening. A water-resistant liner is disposed within the container for receiving and retaining waste therein.

BRIEF DESCRIPTION OF THE DRAWINGS

The following detailed description is best understood with reference to the following drawings in which.

DETAILED DESCRIPTION OF THE INVENTION

Figure 1:
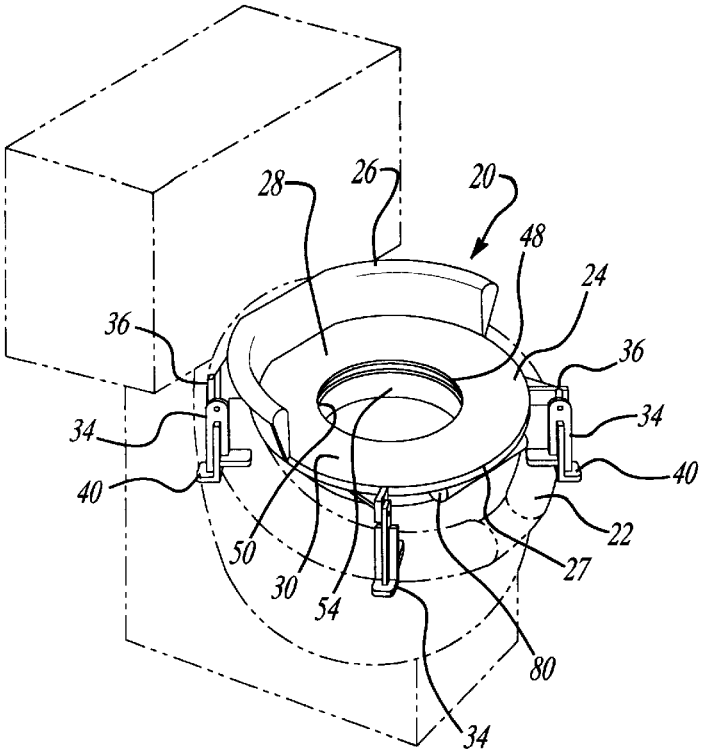
FIG. 1 is a perspective view of a conventional toilet in combination with a portable child sized potty assembly of the subject invention.

Referring to the Figures, wherein like numerals indicate or corresponding parts throughout the several views, there is disclosed a portable child sized potty assembly 20 shown in FIG. 1 which is adaptable for use both with an existing toilet seat 22 or on its own. The child sized potty 20 has a seat portion 24 with a backguard 26 extending partially around the rear portion 28 of the seat 24 to maintain the child in position on the seat 24. The seat portion 24 is shaped like a conventional toilet seat top except it has smaller dimensions suitable for that of a toddler or small child.

Figure 2:
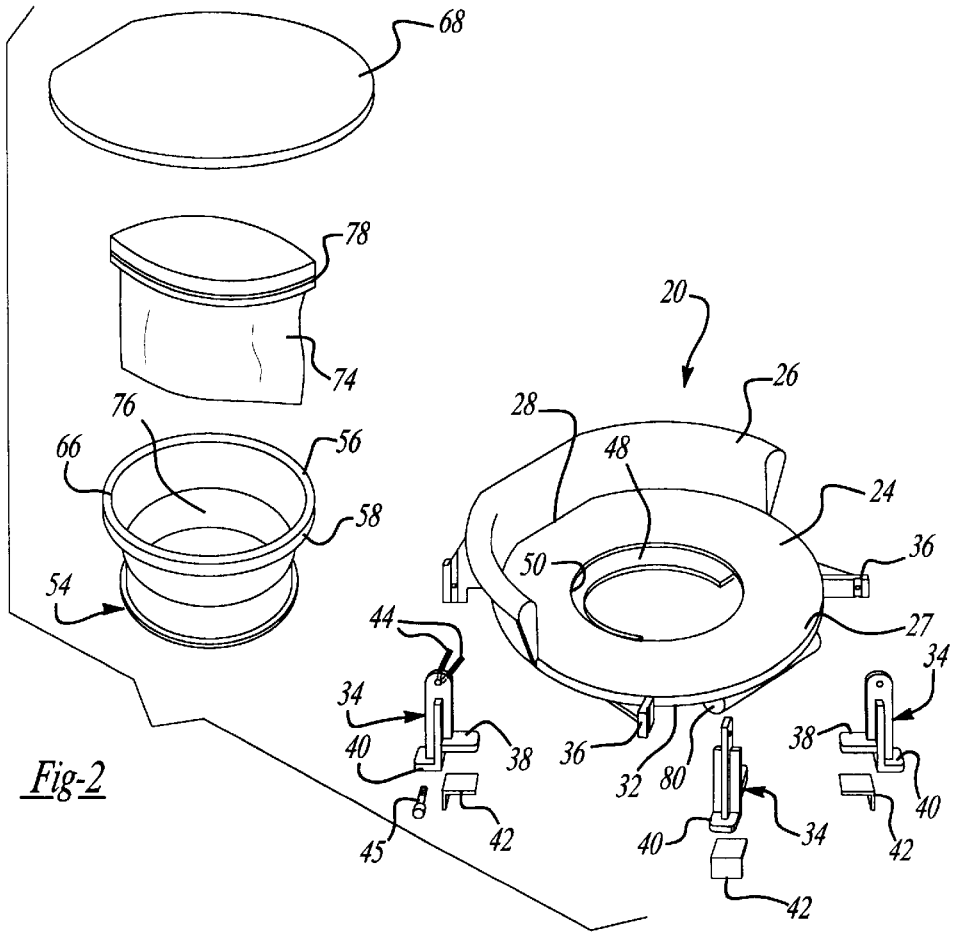
FIG. 2 is an exploded perspective view of the child sized potty assembly of the subject invention.
Figure 3:
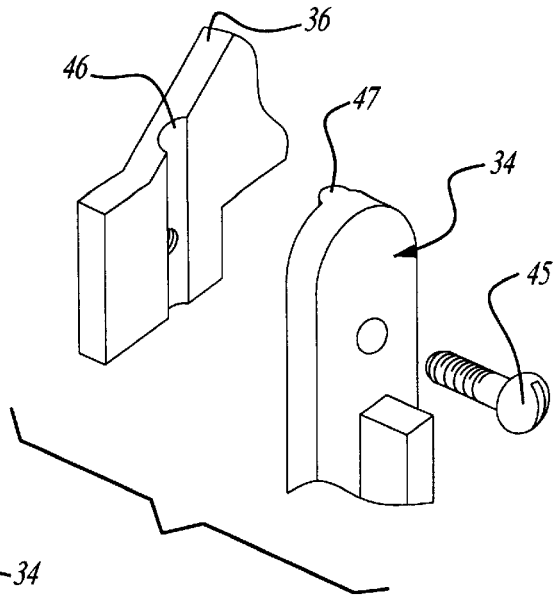
FIG. 3 is an exploded perspective view of a locking mechanism for a leg of the subject invention.
Figure 4:
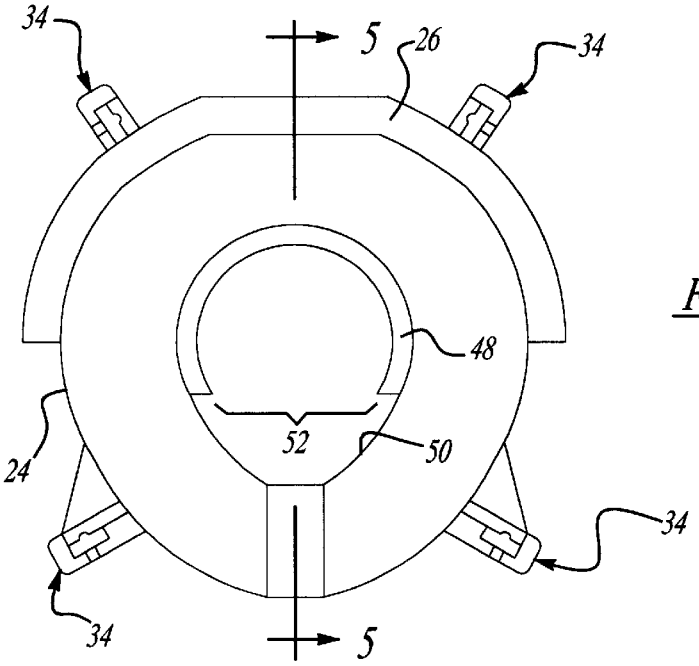
FIG. 4 is a top view of the assembly of the subject invention.

As shown in FIG. 1, the child sized potty seat 20 has a top surface 30 and a bottom surface 32 and includes legs 34 which extend downwardly from supports 36 extending from the bottom 32 and/or the side of the seat 24. In this embodiment, the legs 34 are mounted to pivot 180° between an upward position for transporting and a downward position for use with existing toilet seats 22. Each leg 34 has a flange 38 extending inwardly towards the center of the seat 24 and a foot 40 at the bottom thereof. The inwardly extending flange 38 is formed to allow the child potty 20 to rest on the conventional toilet seat 22 and the feet 40 are positioned to rest on a large toilet seat 22 or on a flat surface in the event that a conventional toilet cannot be found. A resilient pad 42 may be mounted to the bottom or underside of each flange 38 to prevent marking of the toilet seat 22 and/or to provide a non-slip surface for safe attachment to a toilet seat. Each leg 34 may be provided with a pair of detents 44 as shown in FIG. 2 to lock the legs 34 in either the folded position or in the lowered position as shown. A wing nut and screw may be used to tighten or secure the legs 34 in either position. Alternatively, the legs 34 may be provided with an interlocking slot 46 and detent 47 as shown in FIG. 3.

In one embodiment shown in FIGS. 1, 2, 4, and 5, a flange 48 extends downwardly from underneath the seat 24. The flange 48 is disposed adjacent to a central aperture 50 of the seat 24. The flange 48 is disposed adjacent to and is disposed substantially about at least a portion of the central aperture 50; however, in this embodiment, the flange 48 does not completely enclose the central aperture 50 rather it terminates defining an opening 52 which facilitates the insertion and retention of a collapsible container 54 having a circumferentially disposed flange 56 thereon which engages the flange 48 to receive and retain the container 54 thereon. The opening 52 defined by the flange 48 can be designed and constructed to face either the front 27 or the back 28 of the seat 24 thereby allowing the assembly 20 to be designed such that the container 54 can be inserted from either the front 27 or the rear 28 of the assembly 20.

Figure 7:
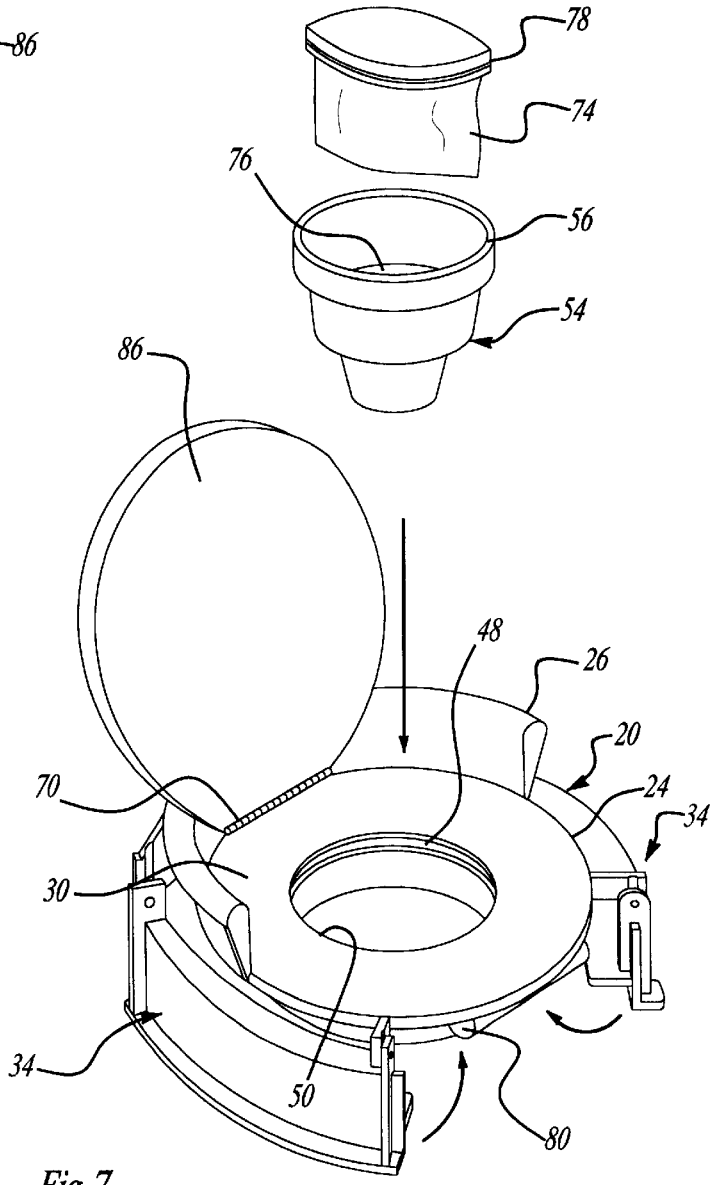
FIG. 7 is partially exploded perspective view of an alternative embodiment of the subject invention.

In another embodiment as shown in FIG. 7, the flange 48 extends downwardly from underneath the seat 24. The flange 48 is substantially circular and is set in radially inwardly a distance from the central aperture 50 of the seat 24. The collapsible container 54 is formed to attach to the flange 48. The collapsible container 54 includes the circumferentially disposed flange or lip 56 which overlappingly engages the flange 48 to support the container 54 within the central aperture 50. In this embodiment, two arcuate legs 34 are utilized rather than the four leg embodiment shown in FIG. 1 and are shown in the downward position for use rather than the upward position for storage and transportation. The arcuate shape permits the assembly 20 to rest properly on a toilet seat and also adds additional strength to the assembly 20. When use of the toilet seat assembly 24 is desired, the container 54 is opened (expanded) and attached to the seat 24 by way of the flange 56.

Figure 8:
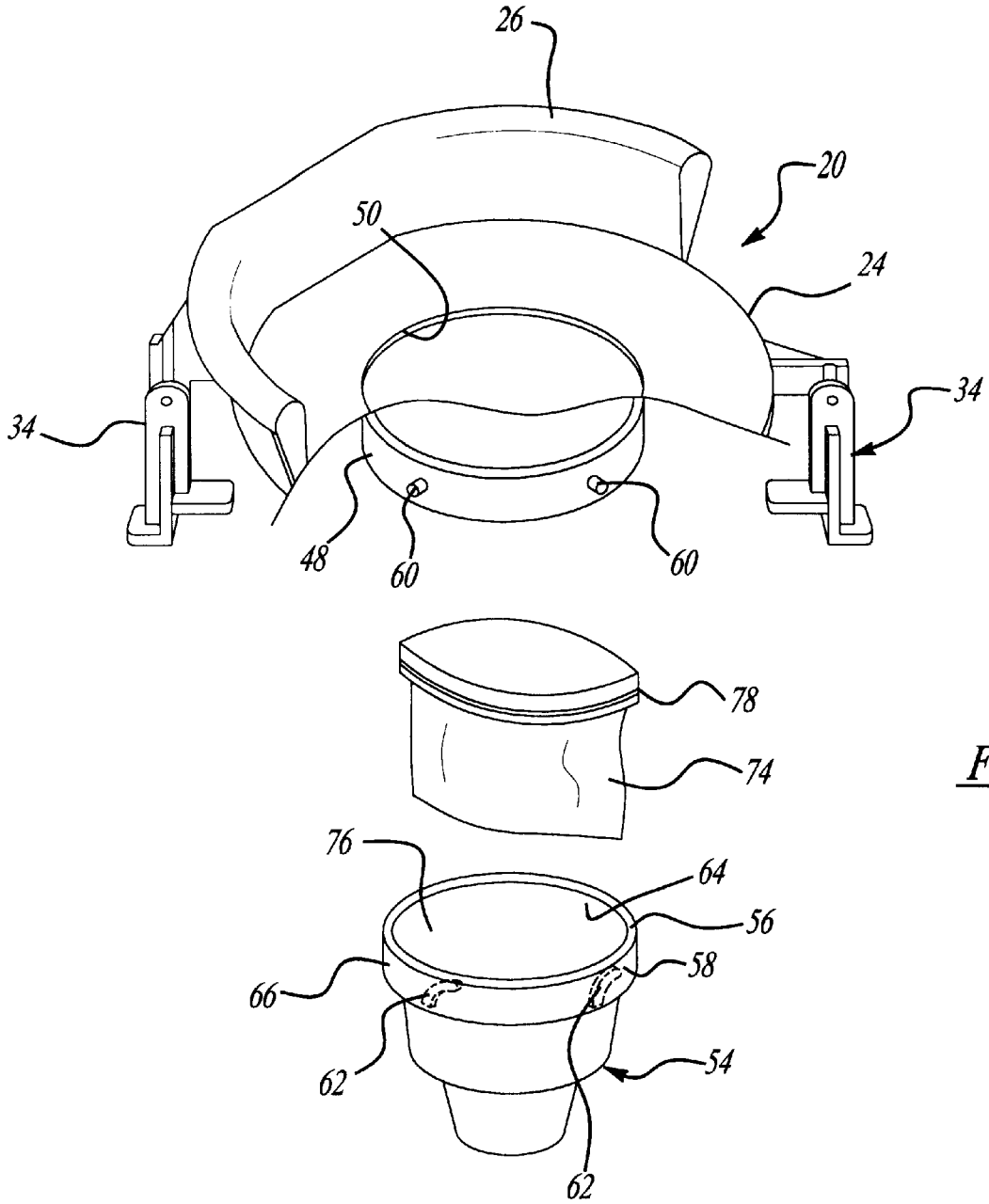
FIG. 8 is a perspective view, partially broken-away, of an alternative embodiment of the subject invention.

In another embodiment of the assembly 20 shown in FIG. 8, the outside surface 58 of the flange 56 can be provided with protrusions 60 which are received within a groove or slot 62 formed on an inside surface 64 of the top section 66 of the container 54. The container 54 is inserted upwardly and twisted so that the protrusions 60 are engaged with the groove or slot 62 to suspend the container 54.

The collapsible container 54 is preferably formed in three sections which telescope together like a collapsible drinking cup for storage and travel. These sections may or may not be separate from each other. That is, the container 54 can be formed from a flexible, unitary piece which can be collapsed onto itself or the sections can move relatively independently from each other and be formed of essentially separate pieces.

Referring to FIG. 2, a cover 68 for the container 54 may also be provided. The cover 68 can be formed so that it may be used when the container 54 is mounted in the toilet seat 24 or removed from the seat 24. The cover 68 can be a removable, non-attached piece as shown in FIG. 2 or it can be pivotally attached or hinged with a hinge to a top surface 30 of the seat 24 as shown in FIG. 7. The container may or may not be used when the assembly 20 is placed on top of a conventional toilet.

A plastic liner 74 formed to extend over the top 66 of the container 54 and completely lines the inside of the container 54 is inserted with the opening 76 of the container 54. The liner 74 is formed to receive the child's waste and after use, the liner 74 is removed from the container 54 and the liner 74 is discarded in an appropriate waste receptacle. The liner 74 may be provided with a closure 78 such as an interlocking closure made of interlocking members which form a water-tight seal therebetween, such as a "ZIPLOCK" bag, at the top to seal the liner 74 while being transported for proper and suitable disposal. Alternatively, the assembly 20 can be utilized without the liner 74.

Figure 5:
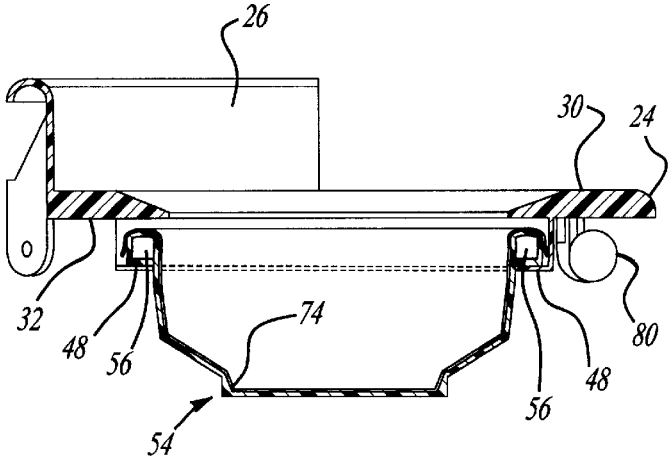
FIG. 5 is a cross-sectional view of the assembly of the subject invention taken along line 5—5 of FIG. 4.

As best shown in FIG. 5, a body shield 80 for preventing waste from splashing outwardly or escaping the assembly 20 may be attached to the bottom 32 of the seat 24. The body shield 80 is preferably in the form of a plastic sheet which can be extended for use and then rolled up and clipped in place for storage; however, it may be formed of a less resilient material which could remain deployed all of the time. The body shield 80 may or may not be removable.

Figure 6:
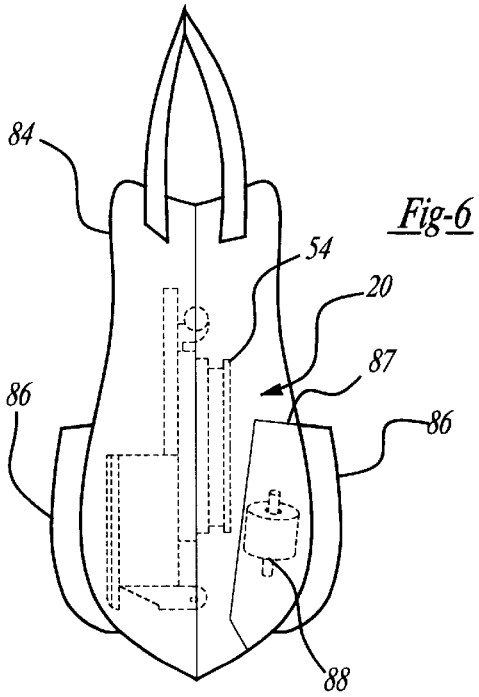
FIG. 6 is a side view of a case having the subject invention disposed therein.

Thus, there is disclosed a portable child potty 20 which is easily transportable in a case 84 (shown in FIG. 6) with both the legs 34 folded and the container 54 collapsed. The case 84 can include a pocket 86 disposed thereon and can also include a compartment 87 for containing a roll of toilet tissue 88 therein. The potty assembly 20 may be easily used for boating, camping, and all types of travel. To use the potty assembly 20, the container 54 is unfolded or re-expanded, is lined with the liner 74, and is attached to the flange 48 of the seat 24. The legs 34 are folded to the lowered position and the potty assembly 20 is ready for use either on a conventional toilet seat 22 or by itself (stand alone).

In view of the teaching presented herein, other modifications and variations of the present inventions will be readily apparent to those of skill in the art. The foregoing drawings, discussion, and description are illustrative of some embodiments of the present invention, but are not meant to be limitations on the practice thereof It is the following claims, including all equivalents, which define the scope of the invention.

Any patents or publications mentioned in this specification are indicative of the levels of those skilled in the art to which the invention pertains. These patents and publications are herein incorporated by reference to the same extent as if each individual publication was specifically and individually indicated to be incorporated by reference.

What is claimed:

1. A child toilet assembly, said assembly comprising:

a seat having a top surface and a bottom surface, a front region and a rear region, and a central aperture disposed therein;

at least two downwardly extending legs, said legs being attached to a support and pivotable between an upward position for transporting said assembly and a downward position for use alone or with an existing conventional toilet or seat, each of said legs having an inwardly extending flange and a foot, said flange being adapted to engage an existing conventional toilet or toilet seat and said foot being adapted to engage a flat surface when said assembly is used alone;

a retainer disposed adjacent said central aperture;

a container having an opening and an attachment mechanism disposed adjacent to said opening, said attachment mechanism on said container being adapted to engage said retainer disposed adjacent to said central opening; and a water-resistant liner disposed within said container for receiving and retaining waste therein.

2. A toilet assembly according to claim 1 further comprising a back portion extending partially around said rear region adapted to maintain a child in position on said seat.

3. A toilet assembly according to claim 1, wherein said retainer comprises a flange disposed about at least a portion of said central aperture.

4. A toilet assembly according to claim 1, wherein said attachment mechanism comprises a flange.

5. A toilet assembly according to claim 1, wherein said water resistant liner comprises a closure mechanism.

6. A toilet assembly according to claim 5, wherein said closure mechanism comprises interlocking members which form a water-tight seal therebetween.

7. A toilet assembly according to claim 1, wherein said container is comprised of at least two sections which telescopingly collapse within each other.

8. A toilet assembly according to claim 1, wherein said assembly further comprises a cover.

9. A toilet assembly according to claim 1, wherein each of said inwardly extending flanges includes a resilient pad disposed thereon.

10. A toilet assembly according to claim 1, wherein a shield is affixed to said seat to prevent the escape of waste.

11. A toilet assembly according to claim 10, wherein said shield is affixed to said bottom surface of said seat.

12. A toilet assembly according to claim 1, wherein each of said legs includes a locking mechanism for securing each of said legs in either said upward position or said downward position.

13. A toilet assembly according to claim 1, wherein said retainer disposed adjacent to said central aperture includes a protrusion which is matingly received in a slots or grooves disposed in said container whereby said container is attached to said seat.

14. A portable toilet assembly, said assembly comprising:

a seat having a top surface and a bottom surface, a front region and a rear region, and a central aperture disposed therein;

at least two downwardly extending legs, said legs being attached to a support and pivotable between an upward position for transporting said assembly and a downward position for use alone or with an existing conventional toilet or toilet seat, each of said legs having an inwardly extending flange and a foot, said flange being adapted to engage an existing conventional toilet or toilet seat and said foot being adapted to engage a flat surface when said assembly is used alone;

a retainer disposed adjacent to said central aperture;

a container having an opening and having an attachment mechanism disposed adjacent to said openings said attachment mechanism on said container being adapted to engage said retainer disposed adjacent to said central opening;

a water-resistant liner disposed within said container for receiving and retaining waste therein; and a case dimensioned to contain said assembly therein.

15. A toilet assembly according to claim 14 further comprising a back portion extending partially around said rear region adapted to maintain a child in position on said seat.

16. A toilet assembly according to claim 14, wherein said retainer comprises a flange disposed about at least a portion of said central aperture.

17. A toilet assembly according to claim 14, wherein said attachment mechanism comprises a flange.

18. A child toilet assembly, said assembly comprising:

a seat having a top surface and a bottom surface, a front region and a rear region, and a central aperture disposed therein;

at least two downwardly extending legs, said legs being attached to a support and pivotable between an upward position for transporting said assembly and a downward position for use alone or with an existing conventional toilet or seat;

a retainer disposed adjacent said central aperture;

a container having an opening and an attachment mechanism disposed adjacent to said opening, said container comprised of at least two sections which telescopingly collapse within each other, said attachment mechanism on said container being adapted to engage said retainer disposed adjacent to said central opening; and a water-resistant liner disposed within said container for receiving and retaining waste therein.

19. A toilet assembly according to claim 14, wherein said container is comprised of at least two sections which telescopingly collapse within each other.

* * * * *